US008416541B1

(12) United States Patent
White

(10) Patent No.: US 8,416,541 B1
(45) Date of Patent: Apr. 9, 2013

(54) DISCONNECT SWITCH ARC ELIMINATOR

(76) Inventor: Paul F. White, Wellesley, MA (US)

( * ) Notice: Subject to any disclaimer, the term of this patent is extended or adjusted under 35 U.S.C. 154(b) by 417 days.

(21) Appl. No.: 12/661,163

(22) Filed: Mar. 11, 2010

Related U.S. Application Data

(60) Provisional application No. 61/211,032, filed on Mar. 26, 2009.

(51) Int. Cl.
*H01H 73/18* (2006.01)

(52) U.S. Cl. ..... 361/2; 361/6; 361/7; 361/8

(58) Field of Classification Search ..... 361/8, 2, 361/6, 7
See application file for complete search history.

(56) References Cited

U.S. PATENT DOCUMENTS

| | | | | | |
|---|---|---|---|---|---|
| 1,560,165 | A * | 11/1925 | Johnson, Jr. | ..... | 200/261 |
| 1,954,220 | A * | 4/1934 | Murray, Jr. | ..... | 337/144 |
| 3,997,749 | A * | 12/1976 | Hanagan | ..... | 200/318.1 |
| 5,578,980 | A * | 11/1996 | Okubo et al. | ..... | 335/132 |
| 5,609,245 | A * | 3/1997 | Cassity et al. | ..... | 200/283 |
| 5,652,688 | A * | 7/1997 | Lee | ..... | 361/13 |
| 7,079,363 | B2 * | 7/2006 | Chung | ..... | 361/13 |

* cited by examiner

*Primary Examiner* — Rexford Barnie
*Assistant Examiner* — Zeev V Kitov
(74) *Attorney, Agent, or Firm* — William Nitkin

(57) ABSTRACT

A device that allows standard non-load break disconnect switches to become full load break disconnect switches in that they can interrupt high levels of their rated current with no arcing or burning when the switch is opened under load in direct current use on electric railways, electric trolley bus systems, mine operations and motor controls.

16 Claims, 6 Drawing Sheets

FIG.4
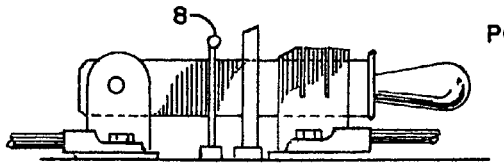
POSITION 1
FIG.5
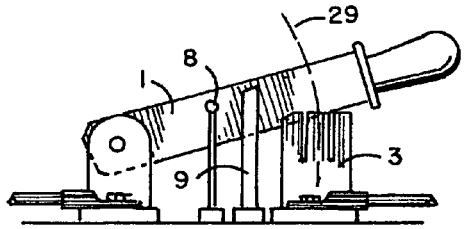
POSITION 2
FIG.6
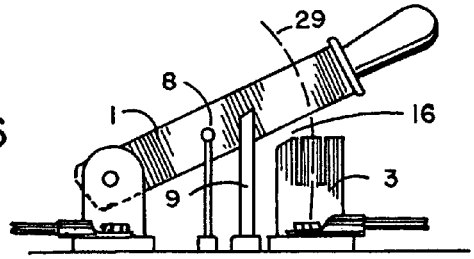
POSITION 3
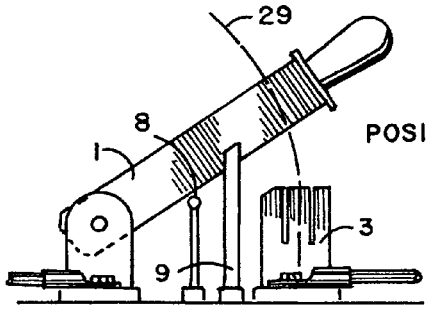
POSITION 4
FIG. 7
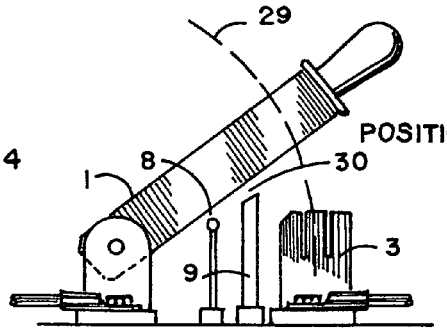
POSITION 5
FIG. 8

SECTION A-A

SECTION B-B

SECTION VIEW A-A

N-CHANNEL IGBT
CROSS SECTION

DISCONNECT SWITCH ARC ELIMINATOR

This application claims priority and benefit of a provisional patent application entitled Disconnect Switch Arc Eliminator, Application No. 61/211,032 filed Mar. 26, 2009, now pending.

BACKGROUND OF THE INVENTION

Description of the Prior Art

Non-load break switches are devices that physically break an electrical circuit by being operated from a closed position to an open position. They typically consist of a blade that is attached to a hinged support in such a manner that the blade can rotate from 0 degrees or any intermediate in-between angle, typically 51 degrees to 180 degrees in the open position. When in the closed position at 0 degree, the blade typically makes contact with a jaw support by inserting itself into the jaws of said jaw support.

Both load break and non-load break disconnect switches physically disconnect an electrical circuit by being operated where the blade is placed in either a 51 degree, a 180 degree or some other angle in the open position so that the blade no longer makes contact between the hinge support and the jaw support which are connected to a line and load, respectively, of their electrical circuit.

When the switch is closed, being that the blade is in the zero degree position when the hinge is physically connected to the jaw, electrical current can flow between the hinge and jaw and the circuit is complete. When the switch is open, being that the blade is in either the 51 degree or 180 degree or some other angled position when the hinge is no longer physically connected to the jaw, electrical current does not flow and the circuit is incomplete or open.

If a non-load break switch is opened with no electrical current flowing whether energized or not, no arcing takes place because there is no interruption of current. If the switch is opened when there is a flow of current, an arc develops between the jaw and the blade and it extends from the jaw and follows the blade until there is sufficient distance between the two components so that the arc cannot be sustained and it self-extinguishes.

This typically holds true for non-load break style disconnect switches that are hinged and can open 180 degrees if the intensity of the current is not too severe. For knife blade switches that are designed to only open 51 degrees, an interruption of current of almost any intensity does not occur and the resulting arc is sustained. Another type of switch, with an opening circular motion of swing angle limited to 51 degrees, uses a pressure contact system at the primary jaw where mechanical pressure is placed on it to press hard against the primary jaw. When the switch is in the closed position, the primary blade inserts into the primary jaw and mechanical levers press the jaw tight onto the blade, providing a high pressure, low resistance connection without arcing. In the opening process the operating handle, which is generally on the side of the switch enclosure and connected to the blade by linkage, partially moves in the opening process so that pressure to the jaws from the mechanical linkage is relieved and the fit between the jaw and the blade is loose. With a relaxation of pressure between the jaw and blade arcing commences between the two surfaces and burning and pitting occur. With severe burning, welding can take place between the surfaces so that the blade cannot be opened.

To prevent jaw blade arcing, the electrical circuit (power section) which feeds the switch, also referred to as the line side must be de-energized (killed) prior to opening the switch. This becomes problematic in that the entire power section must be killed in order for the switch to be operated, affecting other operations on the railway system.

In the closing of pressure bolted disconnect switches the same problem of arcing is encountered as the blade, when seated in the jaw, initially experiences a loose fit and, if the power section feeding the switch is energized (alive), arcing will occur in the closing process until the mechanical linkage can press the jaws tight against the blade. If the load side of the switch is to be killed by opening the switch, the arcing which takes place during the opening process prevents the power from being killed because arcing starts as soon as the bolted pressure is released. As the blade is opened under load and as the blade moves through its opening process to the full open position of 51 degrees, there is insufficient distance between the blade and jaw to break the arc and it is sustained. The continuation of arcing is analogous to welding and current will continue to flow and the load side of the power section will remain alive until there is enough metal melted away from burning to create a sufficient gap length which will cause cessation of the arc with resulting switch destruction.

When the 180 degree non-load break switch is opened under full load capacity for which the switch assembly is designed and carrying its rated current in the closed position, which on electric railways, electric trolley bus systems, mine operations, or DC motor control can be typically up to 4,000 amperes, the arc is so intense and of such magnitude that an explosion ensues and severely damages the equipment.

Load break switches currently available and in use are designed to interrupt high current of particular magnitudes according to the requirements of the switch. To achieve this capability, they may have a series of contacts which switch the current as it is being opened to divide it between the contacts so that each one interrupts a lessor multiple of the total load current.

Other types of load break switches utilize arc shields and magnetic blowout devices to help decrease the length of the arc or split it through arc shield baffles in an attempt to diminish and extinguish it.

With all types of load break disconnect switches, an arc is created as the device opens under load and each type of switch extinguishes it in its own particular manner. Due to the severe burning that takes place, these types of load break switches have limited amounts of operational sequence openings under load where, when they reach their limit of openings under load, burnt out arc extinguishing components and switch parts must be replaced.

For non-load break switches which must be operated with a high current load of varying magnitude, the electrical circuit is typically killed at the source by opening substation circuit breakers to stop the flow of electrical current through the switch. The switch is then opened and the electrical circuit made alive. The switches can generally be closed in an energized mode as current is not interrupted but only if they are a fast closing type of switch of the non-bolted pressure type as slow closing will cause arcing.

A primary safety feature of disconnect switches is their ability to physically break the electrical connection of the circuit. For "Lock Out/Tag Out" procedures used in the process of killing power sections, codes and standards require a physical break that can be visually observed to indicate that the position of the switch is open. With electronic switching devices such as transistors or other various type electronic devices, there is no physical break to observe as the device is an enclosed unit with no moving parts. There is also the possibility of internal component breakdown so that the controlling circuit that turns the device on or off can break down due to heat or voltage spikes and turn the device on or the device can short circuit and cause the power section to become alive. These possibilities make electronic switching devices potentially unsafe. With no observable physical break, they are not suitable for use in the killing of power sections when protection to human life is critical.

Other electronic switching devices such as metal oxide semiconductor field effect transistors (MOSFETs) and insulated gate bipolar transistors (IGBTs) are used in conjunction with other electronic devices or mechanical switches to decrease or suppress arcing across contacts. In U.S. Pat. No. 5,652,688 to Lee, Lee includes an IGBT with a Darlington combination of a field-effect transistor and bipolar junction transistor connected across switching contacts to suppress or provide extinction of arcing.

Such method is used for the electrical contacts of microprocessor relays used for operation of trip coils in electrical circuit breakers.

Lee further states that the electrical contacts being suppressed carry a medium range of current up to 10 amperes. The device is not connected across the contacts of the high current circuit breaker which typically interrupts current above and well beyond the stated 1,000 amperes but on the relay controlling the circuit breaker.

Lee further states that in the operation of the wiper arm 16, arcing may develop in the wiper arm and one contact and, if so, the arc extinction characteristic of the contacts 18 and 20 would complete the arc extinguish process. The IGBT used in this invention relies on sub components such as a capacitor 30 and Zener diode 32 to operate. It further relies on a metal oxide varistor 22 to force any inductive current produced to zero so that the circuit 30 with wiper arm 16 in the open position is normalized and the IGBT is turned off. Lee describes and claims that the arc suppression means is not just one device but a circuit and operation of the arc suppression is dependent upon the additional components comprised in this circuit and they must be properly matched for the current that is to be interrupted.

The method applied by Lee for arc suppression is not suitable for the application of arc suppression and prevention in the invention disclosed as it is unsuitable for the high current high voltage devices for which the disclosed invention is intended which can be 4,000 amperes or greater. In Lee, the wiper arm 16 has a hinge connected to negative, one jaw connects to positive 18 and the second jaw connects to contact 20 which is connected to a resistor 34 and gate 40 of the IGBT 36 when in the closed position and also simultaneously to negative. In this design configuration as described by Lee, the device cannot be used in a manner consistent with that described in the disclosed invention both physically and electrically, and that as wiper arm 16 is operated to make contact with contacts 18 and 20 there is no physical break in the arc suppression circuit components where the electrical breakdown of IGBT 36 would cause current to flow when the wiper arm 16 is in either the open or the closed position.

In still another arc suppression circuit as disclosed in U.S. Pat. No. 4,658,320 to Hongel, a means to suppress arcing across the contacts of a switch is described through a circuit 10 comprising a metal-oxide-semiconductor field effect transistor (MOSFET) Q1 which shunts the electrical load around the switch S1 when it is opened for a short period of time. MOSFET Q1 is controlled by voltage across a capacitor $C_2$. Hongel describes the process of opening switch S1 in that he states a voltage $V_t$ appears across the switch terminals 2 and 4 and that it is normally low at the instant of opening. Hongel further states that this voltage is kept low due to the capacitance and inductive load of the circuit, but does not consider resistance load. As soon as the switch opens past contact 4, arcing develops as the capacitor $C_1$ does not charge instantaneously and there is a slight time delay from initial opening of the switch S1 past contact 4 and the charging of capacitor $C_1$ to a sufficient voltage to turn on MOSFET Q1 so that it turns on and shunts arc current around switch Q1 in the time for sufficient charge to develop, arcing on contact 4 and switch S1 will occur.

The method for arc suppression as applied by Hongel does not prevent arcing as the MOSFET is not turned on prior to opening of the switch S1 and arcing occurs. It also does not provide a physical break between DC supply 6 and load 8 when the switch S1 is open. The circuit components in 10 can short circuit and break down due to heat or electrical insulation breakdown and not provide fail safe operation.

In the disclosed invention an embodiment of it uses an attached blade oriented 90 degrees to the primary blade. In U.S. Pat. No. 5,073,686 to Gabriel an arm 24 is attached to knife blade 12 in a fashion 90 degrees to each other. Arm 24 is fixed and not removable or adjustable and does not contact any jaw or other component when knife blade 24 is used for a manual connection of a connector 26. Power is provided to arm 24, also called bug stud 24 from knife blade 12 when the knife blade is in position, as seen in FIG. 3, making contact with terminal 20. Bug stud 24 is not a secondary knife blade which automatically makes contact in a switch jaw 20, 18 and 22 as it functions as a stud for manual attachment of 600 volt DC shop power socket 16 to provide power to a rail vehicle undergoing maintenance. The use of arm 24 does not provide for insertion into a secondary jaw or any type of jaw and can only perform its intended function if the switch operator person physically connects connector 26 to the arm 24.

The arm 24 attachment by Gabriel does not allow for placement on the primary blade of an existing switch of non-load break type as it is permanently attached to blade 12 as shown on FIG. 4.

SUMMARY OF THE INVENTION

The invention described herein is designed to convert either existing or new disconnect switches from a non-load break type of device to a full current load break disconnect switch. This is accomplished by adding the arc eliminator device to the switch assembly. The device consists of an insulated gate bipolar transistor (IGBT) with choke coils that electrically connects it to a secondary jaw inserted into the switch and the primary jaw which is part of the switch. A separate contact is placed in proximity to the switch blade so that as it opens, voltage is placed on it and it is connected to the gate terminal of the IGBT and it becomes the gate circuit.

IGBT devices are used for high speed switching applications and not as disconnect switches. There are three terminals associated with these devices, the gate, emitter and collector. A voltage source is connected to the collector and the load source is connected to the emitter. No current can flow between the two terminals E and C when there is no voltage present on the gate terminal.

Turn-On Transients:

When a positive voltage is applied from the emitter to gate terminals electrons are drawn to the gate terminal in the body region (FIG. 18). If the gate emitter voltage is at or above what is called the threshold voltage, enough electrons are drawn towards the gate to form a conduction channel across the body region, allowing current to flow from the collector to the emitter. A simplified equivalent circuit is shown in FIG. 19.

When current is allowed to flow, this is when the IGBT is essentially turned on.

Turn-Off Transients:

When the gate voltage across the gate emitter junction drops below the threshold voltage such as when there is no voltage on the gate terminal, the collector to emitter voltage starts increasing linearly. The IGBT remains conductive and the IGBT current falls down linearly. The rapid drop in IGBT current occurs during this time interval which corresponds to the turn-off of the MOSFET part of the device and the device ceases to allow current to flow from the collector to the emitter and the IGBT is essentially turned off.

When the switch is in the closed position at zero degrees, the gate terminal is isolated and no voltage is present on the IGBT gate terminal and the IGBT is turned off. When the switch blade is opened but still in the primary jaw and allowing current to flow through it, the blade makes contact with the gate contact, placing a voltage on it which then causes the gate terminal to have voltage placed on it. The blade is in contact with the secondary jaw when closed and in the opening process. As soon as the gate terminal has voltage placed on it, it turns on the IGBT so that it conducts current which flows from the blade to both the primary and secondary jaws. As the blade is further opened, it is no longer in contact with the primary jaw so that no current flows from the blade to the primary jaw and that all current flows from the hinge through the blade to the secondary jaw, through the IGBT and to the primary jaw cable terminal. At this junction all current is flowing through the IGBT.

As the blade is opened further, contact between it and the gate contact is broken and no voltage is on the gate terminal. When voltage at the gate terminal ceases, the IGBT turns off virtually instantaneously so that all current ceases to flow and the electrical circuit connected to the hinge portion of the power section is killed. In the process of turning off through the IGBT, no arcing occurs regardless of the magnitude of current.

When the blade is further opened, it is no longer in contact with the secondary jaw and as the blade completes its opening swing to either 51 degrees, some intermediate angle or 180 degrees, it is considered completely in the open position and the electric circuit has been opened and the line side of the power section killed. Where the blade height compromises operation of the gate contact and the IGBT would be turned on through the full swing of the blade as it opens past the secondary jaw, an extension button can be attached to the blade to where the gate control would make contact. The extension button would provide an electrical contact for the gate contact and would be touching it to complete the gate circuit to turn on or off the IGBT when the blade is in certain critical positions in its throw pattern. The outside U-clamp has a machined countersink for insertion of the button contact so that it will not rotate or slip when subjected to sliding against the gate contact.

If the IGBT is allowed to remain "turned on" as the blade opens past the secondary jaw, an arc will develop between the jaw and the blade because even though the device is turned on, parallel electrical current flows from the blade to the secondary jaw and it will not be completely interrupted electronically through the IGBT but physically at the junction of the blade and secondary jaw. The gate control button extension allows the gate circuit to be broken and the IGBT turned off when the blade is still in contact with the secondary jaw.

Some switches are constructed so that it is difficult or not practical to insert the secondary jaw between the hinge insulated mounting block and the primary jaw insulated mounting block. In such cases a supplementary blade can be attached to the primary blade so that clearance for insulation purposes can be achieved or positioning for proper operation of the IGBT can be realized.

With pressure bolted disconnect switches the gate contact is not used for the primary blade and a gate contact is utilized at the switch side operating handle so that as the handle/operating mechanism is actuated, the gate contact is activated and the contact allows voltage to pass through it in the same manner as the primary blade gate contact and the IGBT device is turned on before blade movement commences and prior to release of pressure on the primary jaw. As the handle/operating mechanism is further moved, engagement to jaw pressure linkage is released so that the connection between the jaw and blade is relaxed and a loose fit to allow blade opening movement can occur without any arcing.

By turning on the IGBT prior to relaxation of jaw pressure, arcing between the jaw and blade is eliminated because current can flow from the blade through the secondary jaw to the IGBT to the load side cable.

As either the primary blade or secondary blade, should it be required, is opened and in the motion of switch operation all current is transferred from the primary blade (or secondary blade should it be required) to the secondary jaw through the IGBT to the load side cable, and as the primary blade travels further, it clears its position with the primary jaw and when completely clear and in the fully open position, the position of the operating handle ceases to actuate the gate contact so that voltage is no longer present on the gate contact circuit and the IGBT turns off and current ceases to flow. No arcing or burning takes place during this sequence due to the operating characteristics of the IGBT.

BRIEF DESCRIPTION OF THE DRAWINGS

FIG. 4 illustrates a side elevational view of the disconnect switch in sequence of operation in position 1.

FIG. 5 illustrates a side elevational view of the disconnect switch in sequence of operation in position 2.

FIG. 6 illustrates a side elevational view of the disconnect switch in sequence of operation in position 3.

FIG. 7 illustrates a side elevational view of the disconnect switch in sequence of operation in position 4.

FIG. 8 illustrates a side elevational view of the disconnect switch in sequence of operation in position 5.

DESCRIPTION OF THE PREFERRED EMBODIMENT(S)

Figure 1:
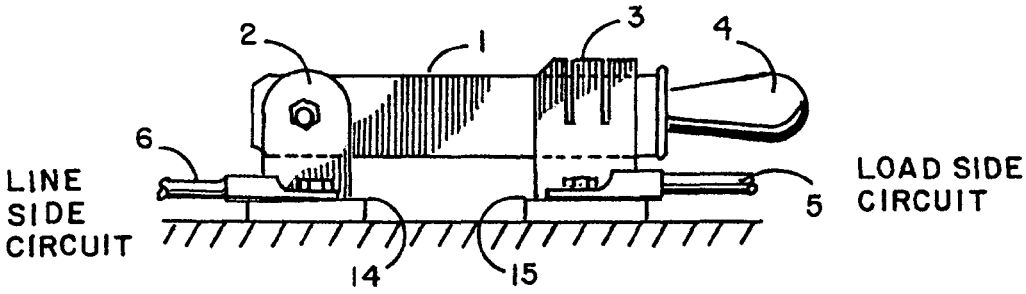
FIG. 1 illustrates a side elevational view of the disconnect switch in the closed position.

Referring to FIG. 1 there is shown the preferred embodiment of the invention applied to a disconnect switch as would be found in an electric railway, electric trolley bus system, mining operation or with motor control apparatus.

Figure 2:
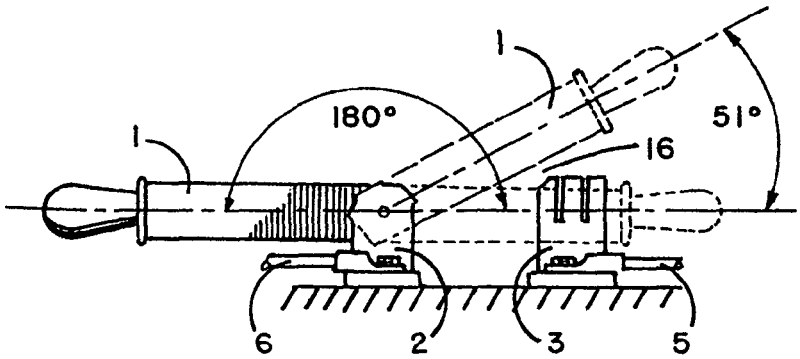
FIG. 2 illustrates a side elevational view of the disconnect switch in the open position at either 51 degrees or 180 degrees.
Figure 3:
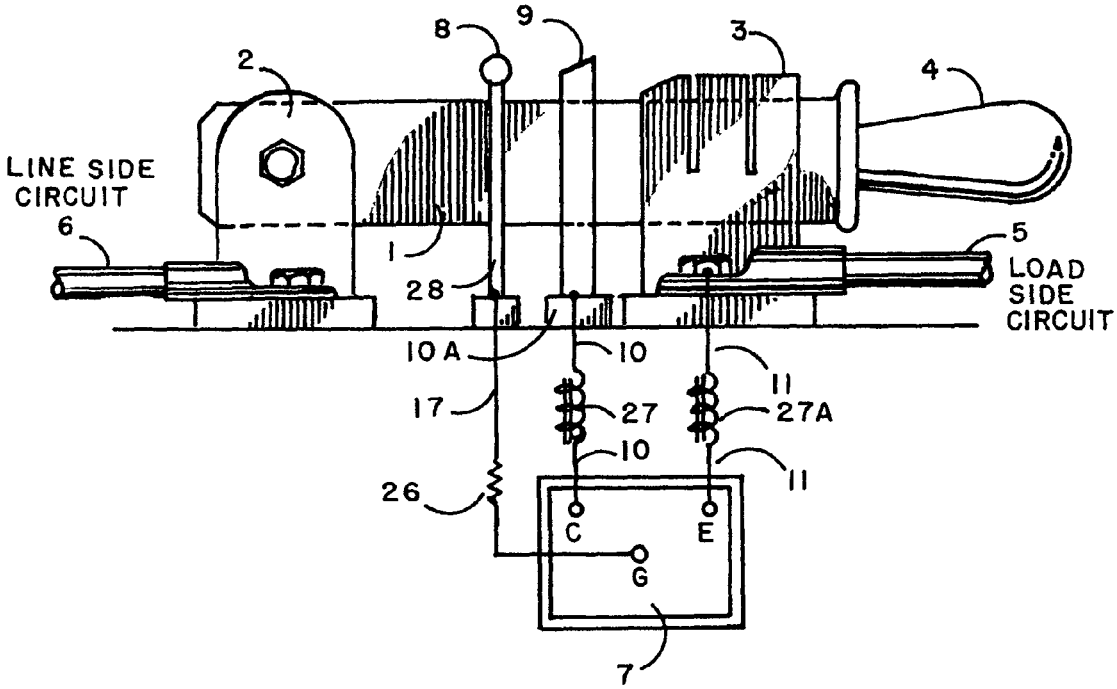
FIG. 3 illustrates a side elevational view of the disconnect switch assembly with arc eliminator switching device with switch in the closed position.

The following components of the equipment are shown in FIG. 3: primary blade 1 of the switch assembly, hinge 2 on hinge insulated mounting block 14 to which primary blade 1 is attached, primary jaw 3 into which primary blade 1 inserts, such primary jaw 3 mounted on jaw insulated mounting block 15, switch handle 4, primary jaw cable (load side circuit) 5, hinge cable (line side circuit) 6, insulated gate bipolar transistor (IGBT) 7, gate contact 8 held by gate contact support 28 attached to gate contact wire 17, secondary jaw 9, secondary jaw connection cable 10, secondary jaw insulated base 10A, choke coil 27, primary jaw connection cable 11, and choke coil 27A. The operation and function of the various components described in terms of the operation of the switch with the disconnect switch arc eliminator are as follows:

Opening of the switch from the closed position FIG. 1 to the open position, FIG. 2 is accomplished by the switch operating person gripping handle 4 and pulling so that primary blade 1 moves in a circular motion from hinge 2 and as such, it passes from the closed position, POSITION 1 shown in FIG. 4 to POSITION 2 shown in FIG. 5. In POSITION 1, FIG. 4 gate contact button 8 is isolated from all voltage and the IGBT 7 is turned off. In POSITION 2, FIG. 5 primary blade 1 is raised in a circular motion 29 so that primary blade 1 is in contact with primary jaw 3, secondary jaw 9, and gate contact 8. As primary blade 1 makes contact with gate contact 8, system voltage is placed on gate contact 8 and its control current flows from gate contact wire 17 through resistor 26 to drop the system voltage to a value to which will safely turn on IGBT 7. When IGBT 7 turns on, current flows from primary blade 1 to primary jaw 3, secondary jaw 9 through secondary jaw connection cable 10, through choke coil 27, into the IGBT 7, into primary jaw connection cable 11, through choke coil 27A and into primary jaw cable 5. As the switch is opened further, primary blade 1 continues its travel along circular motion 29 of the switch operation to a point where it no longer is in contact with primary jaw 3 shown as area 16 and is in contact with secondary jaw 9 and gate contact 8, as shown in POSITION 3, FIG. 6.

No arcing takes place at 16 as primary blade 1 leaves primary jaw 3 because there has been an electrical connection previously established as shown by POSITION 2 in FIG. 5 where the IGBT 7 has been turned on and all current established by the load of the circuit has not been interrupted but completely transferred from primary blade 1 to secondary jaw 9, to IGBT 7, and to jaw cable circuit 5.

With primary blade 1 in POSITION 3, as shown in FIG. 6, no current flows from primary blade 1 into primary jaw 3 due to their no longer being in contact with each other and all current flows from primary blade 1 into secondary jaw 9, to IGBT 7 and to the jaw cable circuit 5.

As primary blade 1 is further opened along circular motion of switch operation 29, as shown on POSITION 4 in FIG. 7, primary blade 1 ceases to make contact with gate contact 8 and no voltage is present on that contact. With no voltage on gate contact 8, IGBT 7 turns off instantaneously in such a manner consistent with the operation of IGBT devices.

As shown on POSITION 4 in FIG. 7, primary blade 1 is no longer in contact with gate contact 8 but is still in contact with secondary jaw 9. However, no current will flow from it to jaw cable circuit 5 because IGBT 7 is turned off, and the circuit is open and the load side circuit to which jaw cable circuit 5 is attached has been "killed."

As primary blade 1 is still further opened along circular motion of switch operation 29, it no longer makes contact with secondary jaw 9 at clearance area 30 so that all physical contact no longer occurs. As shown on POSITION 5 in FIG. 8, when the switch is completely in the open position, as shown in FIG. 2, a physical break in the electrical circuit exists and the switch is considered open.

Figure 18:
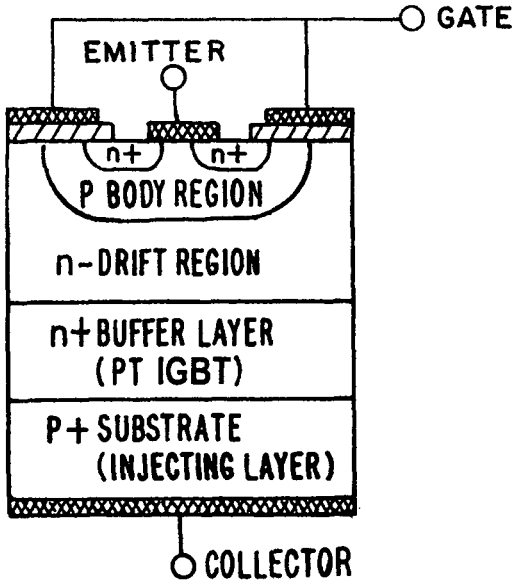
FIG. 18 illustrates a cross sectional schematic view of an IGBT, N-channel type.
Figure 19:
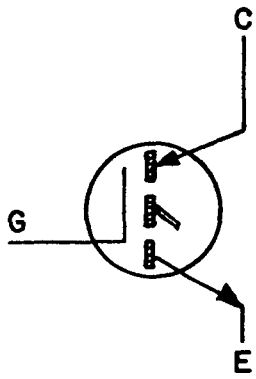
FIG. 19 illustrates a schematic diagram of an IGBT.

Therefore the features of my invention include a device that converts non-load break disconnect switches in use on direct current electric railways, electric trolley bus systems, mine operations and motor control systems to full load break switches. Said device consists of an insulated gate bipolar transistor (IGBT) shown in FIGS. 18 and 19 connected to the switch jaw cable and to a secondary jaw and controlled with a gate circuit connected to a gate contact, in that as the blade is opened under full current load, the IGBT is turned on through a gate contact and conduction of current is through the IGBT and secondary jaw, and as the blade is opened further, it is no longer in contact with the primary jaw and no arc is developed at the breaking of contact between the two, and that all current flows from the blade to the secondary jaw through the IGBT to the hinge cable. As the blade is opened further, the contact between the blade and the gate contact is broken and the IGBT is turned off. When the IGBT is turned off, current is shut off electronically at the IGBT instantaneously so that no arc develops.

Figure 9:
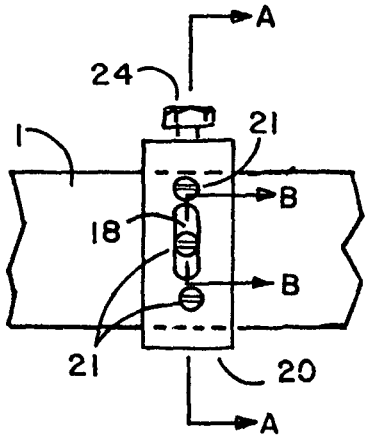
FIG. 9 illustrates a side view of the blade attachment support for the gate contact button.
Figure 9A:
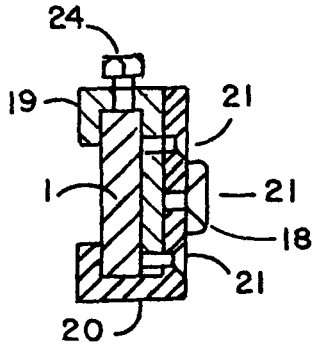
FIG. 9A illustrates a section view through A-A of FIG. 9.
Figure 10:
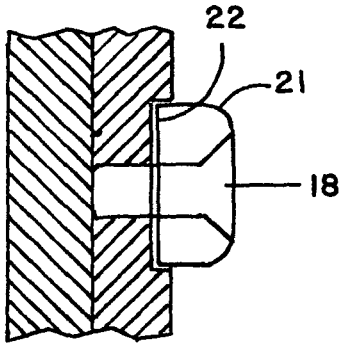
FIG. 10 illustrates section B-B of FIG. 9 showing the gate contact button in a section view.
Figure 12:
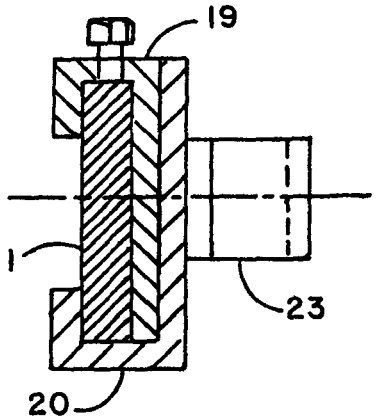
FIG. 12 illustrates a side elevational view through A-A of FIG. 11 showing the supplementary blade attachment support section.
Figure 11:
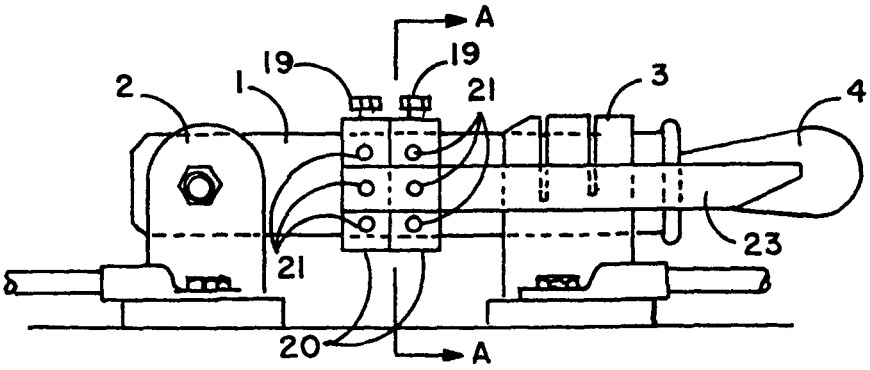
FIG. 11 illustrates a side elevational view of the supplementary blade assembly.

A further embodiment of this invention includes gate contact button extension 18 shown in FIGS. 9, 9A, and 10 that is attached to blade 1 of the switch through a U-clamp formed of inside U-clamp 19 and outside U-clamp 20, as seen in FIG. 12, to limit length of contact with the gate control where the U-clamp formed by inside U-clamp 19 and outside U-clamp 20 can be attached to blade 1 of the switch without removal or alteration of the switch or parts there of held by attachment screws 21 through countersink slots 22.

Figure 13:
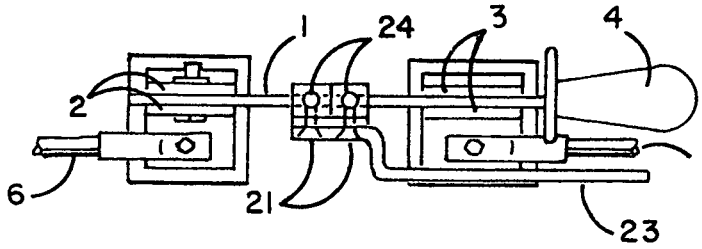
FIG. 13 illustrates a plan view of the primary blade and parallel supplementary blade.
Figure 14:
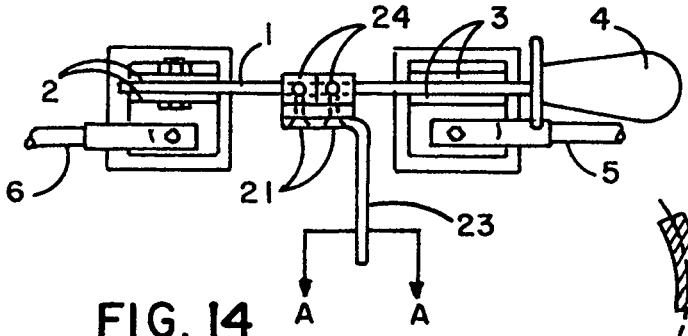
FIG. 14 illustrates a plan view of the primary blade and right angle supplementary blade.
Figure 14A:
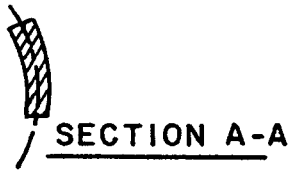
FIG. 14A illustrates a section view of the right angle supplementary blade.
Figure 15:
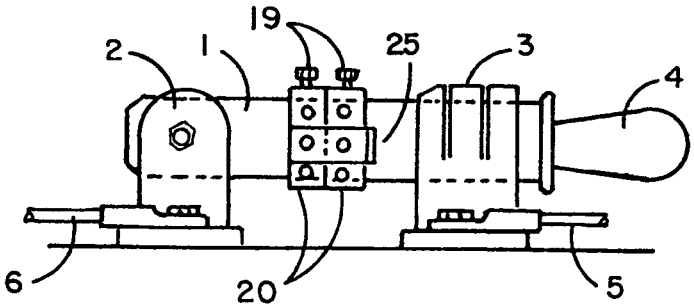
FIG. 15 illustrates a side elevational view of the disconnect switch with right angle supplementary blade attachment.
Figure 16:
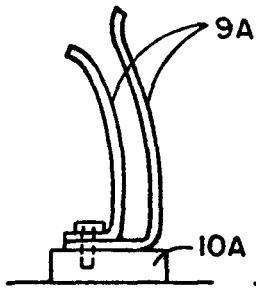
FIG. 16 illustrates an end view of the curved jaw for the right angle supplementary blade.
Figure 16A:
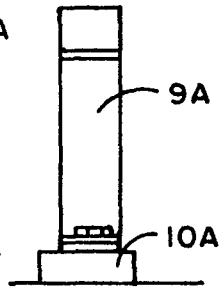
FIG. 16A illustrates a side view of the curved jaw for the right angle supplementary blade.
Figure 17:
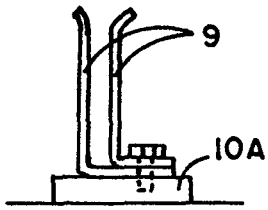
FIG. 17 illustrates an end view of the straight jaw for the parallel supplementary blade.
Figure 17A:
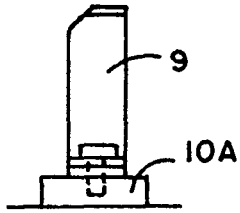
FIG. 17A illustrates a side view of the straight jaw for the parallel supplementary blade.

A still further embodiment of this invention includes a supplementary blade 23, as seen in FIGS. 13, 14 and 14A that is offset but parallel to primary blade 1 and attached to the U-clamp, as described above, where a contact between the switch blade and the secondary jaw can be made outside of the switch assembly area where the distance between hinge 2 and jaw 3 is insufficient to allow placement of the secondary jaw on the blade between the two. Further, supplementary blade 23 can be positioned 90 degrees to blade 1, as seen in FIGS. 13, 14, 14A and 15, and attached to inside U-clamp 19 and outside U-clamp 20, as described above, and by set screws 24, where a contact between supplementary blade 23 and the secondary jaw can be made outside of the switch assembly area when the distance between hinge 2 and jaw 3 is insufficient to allow placement of the secondary jaw on the blade between the hinge and jaw. This invention also can include use of a curved secondary jaw 9A seen in FIGS. 16 and 16A which can allow curved supplementary blade 23, shown in cross-section in FIG. 14A, to be placed 90 degrees to blade 1, as described above, where its curvature allows supplementary blade 23 to be in full mechanical and electrical contact with curved secondary jaw 9 or 9A, as seen in FIGS. 16, 16A, 17, and 17A. Supplementary blade 23 can be curved on its vertical height axis to match the secondary jaw curvature so that it can engage the secondary jaw which is curved, as described above. The degree of curvature is based on the pivoting radius on the blade. This curvature ensures that the blade will fully engage the secondary jaw and be in full and complete mechanical and electrical contact.

Although the present invention has been described with reference to particular embodiments, it will be apparent to those skilled in the art that variations and modifications can be substituted therefor without departing from the principles and spirit of the invention.

I claim:

1. An electrical arc eliminator apparatus suitable for retrofit use with a high current and high voltage disconnect switch assembly, said electrical arc eliminator switch apparatus comprising:

a primary jaw support;

a secondary jaw support for securing an electrically conductive rotatable blade of a disconnect switch forming a jaw cable circuit and which is able to convey electrical energy from the rotatable blade on-demand without regard to whether the rotatable blade is then currently secured to said primary jaw support;

an insulated gated bipolar transistor able to collect and emit high current and high voltage electrical energy on-demand and being comprised of:

a gate terminal operative only when a threshold electrical voltage is passing through it, said gate terminal providing a discrete remote point of electrical contact suitable for attachment with said rotatable blade of said disconnect switch assembly for the conveyance of electrical energy;

a collector terminal in electrical communication with said secondary jaw support and which is able to receive and collect high current and high voltage electrical energy on-demand from said secondary jaw support;

an emitter terminal able to emit and convey high current and high voltage electrical energy only when said gate terminal is operative and which can be placed into electrical communication with the jaw cable circuitry of a disconnect switch assembly;

means for positioning said discrete remote point of electrical contact of said gate terminal upon a rotatable blade of said disconnect switch assembly for the conveyance of electrical energy;

means for positioning said secondary jaw support to secure an electrically conductive rotatable blade of said disconnect switch assembly;

means for placing said emitter terminal into electrical communication with the jaw cable circuitry of a disconnect switch assembly; and wherein said means for positioning said discrete remote point of electrical contact of said gate terminal contacts said rotatable blade simultaneously to turn on said insulated gate bipolar transistor prior to said rotatable blade passing from said primary jaw of said disconnect switch attachment to said rotatable blade.

2. In a disconnect switch assembly suitable for high current and high voltage applications wherein said assembly includes an electrically conductive hinge, at least one electrically conductive blade rotatably joined to said hinge such that said blade can be rotated on demand to any angle position ranging from 0 degrees to about 180 degrees, a primary jaw support for securing the rotatable blade and for conveying electrical energy, means for on-demand rotation of said blade, and electrical cable circuitry individually joined to said hinge and said primary jaw support forming a jaw cable circuit, the improvement of an electrical arc eliminator apparatus comprising:

a secondary jaw support for securing an electrically conductive rotatable blade of a disconnect switch assembly and for conveying electrical energy from the rotatable blade on-demand without regard to whether the rotatable blade is then currently secured to the primary jaw support of the disconnect switch assembly;

an insulated gated bipolar transistor able to collect and emit high current and high voltage electrical energy on-demand and comprised of:

a gate terminal operative only when a threshold electrical voltage is passing through it and which provides a discrete remote point of electrical contact with a rotatable blade of said disconnect switch assembly for the conveyance of electrical energy;

a collector terminal in electrical communication with said secondary jaw support and which is able to receive and collect high current and high voltage electrical energy on-demand from said secondary jaw support;

an emitter terminal able to emit and convey high current and high voltage electrical energy only when said gate terminal is operative and which is in electrical communication with the jaw cable circuitry of said disconnect switch assembly;

means for positioning said discrete remote point of electrical contact of said gate terminal upon a rotatable blade of said disconnect switch assembly for the conveyance of electrical energy;

means for positioning said secondary jaw support for securing an electrically conductive rotatable blade of said disconnect switch assembly;

means for placing said emitter terminal into electrical communication with the jaw cable circuitry of said disconnect switch assembly; and wherein said means for positioning said discrete remote point of electrical contact of said gate terminal contacts said rotatable blade simultaneously to turn on said insulated gate bipolar transistor prior to said rotatable blade passing from said primary jaw of said disconnect switch attachment to said rotatable blade.

3. The electrical arc eliminator apparatus of claim 1 wherein said means for positioning said discrete remote point of electrical contact of said gate terminal upon a rotatable blade of said disconnect switch assembly being coupled to a connector cable and a resistor.

4. The electrical arc eliminator apparatus of claim 2 wherein said means for positioning said discrete remote point of electrical contact of said gate terminal upon a rotatable blade of said disconnect switch assembly being coupled to a connector cable and a resistor.

5. The electrical arc eliminator apparatus of claim 1 wherein said means for positioning said secondary jaw support for securing an electrically conductive rotatable blade of said disconnect switch assembly comprises a connector cable and a choke coil.

6. The electrical arc eliminator apparatus of claim 2 wherein said means for positioning said secondary jaw support for securing an electrically conductive rotatable blade of said disconnect switch assembly comprises a connector cable and a choke coil.

7. The electrical arc eliminator apparatus of claim 1 wherein said means for placing said emitter terminal into electrical communication with the jaw cable circuitry of said disconnect switch assembly comprises a connector cable and a choke coil.

8. The electrical arc eliminator apparatus of claim 2 wherein said means for placing said emitter terminal into electrical communication with the jaw cable circuitry of said disconnect switch assembly comprises a connector cable and a choke coil.

9. The electrical arc eliminator apparatus of claim 1 wherein said means for positioning said discrete remote point of electrical contact of said gate terminal contacts said rotatable blade simultaneously to turn on said insulated gate bipolar transistor prior to said rotatable blade passing from said primary jaw of said disconnect switch attachment to said rotatable blade includes a contact button extension and a U-clamp adapted for attachment to said rotatable blade.

10. The electrical arc eliminator apparatus of claim 2 wherein said means for positioning said discrete remote point of electrical contact of said gate terminal contacts said rotatable blade simultaneously to turn on said insulated gate bipolar transistor prior to said rotatable blade passing from said primary jaw of said disconnect switch attachment to said rotatable blade includes a contact button extension and a U-clamp adapted for attachment to said rotatable blade.

11. The electrical arc eliminator apparatus of claim 1 wherein said disconnect switch assembly comprises a rotatable supplementary blade which is offset, but lies parallel to, said rotatable blade.

12. The electrical arc eliminator apparatus of claim 2 wherein said disconnect switch assembly comprises a rotatable supplementary blade which is offset, but lies parallel to, said rotatable blade.

13. The electrical arc eliminator apparatus of claim 1 wherein said disconnect switch assembly comprises a rotatable detachable blade, curved to match the secondary jaw curvature of blade pivoting radius, which is positioned at about a 90 degree angle to said rotatable blade.

14. The electrical arc eliminator apparatus of claim 2 wherein said disconnect switch assembly comprises a rotatable detachable blade, curved to match the secondary jaw curvature of blade pivoting radius, which is positioned at about a 90 degree angle to said rotatable blade.

15. The electrical arc eliminator apparatus of claim 13 wherein each piece of said supplementary jaw is curved to match the secondary jaw curvature based on blade pivoting radius and is parallel in configuration.

16. The electrical arc eliminator apparatus of claim 14 wherein each piece of said supplementary jaw is curved to match the secondary jaw curvature based on blade pivoting radius and is parallel in configuration.

* * * * *